US006580800B1

(12) United States Patent
Yamasaki et al.

(10) Patent No.: US 6,580,800 B1
(45) Date of Patent: Jun. 17, 2003

(54) ACOUSTIC TRANSDUCER

(75) Inventors: Takayoshi Yamasaki, Toyono-gun (JP); Mikio Suefuji, Hirakata (JP); Kazunori Kono, Hirakata (JP); Tatsuto Mizukami, Hirakata (JP); Hiroshi Yoshiya, Fujiidera (JP); Ryouichi Yagi, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/457,102

(22) Filed: Dec. 7, 1999

(30) Foreign Application Priority Data

Dec. 10, 1998 (JP) ..... 10-351062

(51) Int. Cl.[7] ..... H04R 25/00
(52) U.S. Cl. ..... 381/379; 381/381
(58) Field of Search ..... 381/370, 375, 381/378, 374, 381, 379; 379/430; 181/129, 130

(56) References Cited

U.S. PATENT DOCUMENTS 3,862,378 A * 1/1975 Norris ..... 381/370
5,790,683 A * 8/1998 Salzani
5,970,155 A * 10/1999 Leppalahti
6,038,329 A * 3/2000 Lee ..... 381/370
6,047,076 A * 4/2000 Yang
6,101,260 A * 8/2000 Jensen et al. ..... 381/381

* cited by examiner

*Primary Examiner*—Sinh Tran
(74) *Attorney, Agent, or Firm*—Sheridan Ross PC

(57) ABSTRACT

In an acoustic transducer of the present invention, a connecting part connects a housing and a support of the housing, such that a user's auricle is pinched between the housing and the support cooperatingly. Two hooks shaped into a circular arc embracing a constricted part of the auricle therebetween fix the support. These two hooks are connected such that a gap therebetween can be changed or adjusted.

26 Claims, 12 Drawing Sheets

(a)

(b)

(a)

(b)

(a)

(b)

(a)

(b)

ACOUSTIC TRANSDUCER

BACKGROUND OF THE INVENTION

The present invention relates to an acoustic transducer for reproducing sounds from electric signals outputted by a sound apparatus. More specifically, the invention relates to a headphone, which is mounted for use on a user's auricle, and so on.

As the acoustic transducer mounted for use on an user's auricle, conventionally there have been a headphone type acoustic transducer having a headband and an innnerphone type one having no headbands. In the present invention, among the acoustic transducers to be mounted for use on users' auricles, "innerphone" means a type of the acoustic transducer having no headbands, such as the headphones. The innerphone usually comprises a pair of separate parts, each of which is to be mounted on each of the auricles. Each of the parts comprises a housing having a speaker unit and a support for supporting the housing on the auricle.

The headphone comprises housings, each of which has a speaker unit therein, and a headband, which is connected to the housings at both ends thereof. The headband presses the pair of the housings against the pair of the auricles respectively, for example, by an elastic force, under a condition that the headband is put on the top of the user's head, is set around the back part of the head, or is hung under the chin of the user.

Thus, the headphone can comprise the housings of comparatively large size and heavy weight, since the headphone is supported with its headband. Accordingly, the size of the speaker unit put in the housing can be also made large, so the low tones from the speaker unit can be reproduced very well.

Many people, however, do not like to use the headphone, since the user has to put the headband around the head, and thus, the headband disorders the user's hairstyle and makes the feeling of mounting the headphone worse.

Moreover, storing and carrying the headphone are troublesome since the headband has a fairly large size and it increases the total size of the headphone.

An acoustic transducer, wherein the above-mentioned disadvantages of the headphone are relieved to a certain level is, for instance, an innerphone.

Among the conventional innerphones, there are ones whose housing is about a size of a cavity in the center part of the auricle near the earhole, and the others whose housing is about the same size as the auricle.

In the innerphone whose housing is about the size of the cavity of the auricle, the housing is inserted into the cavity of the auricle. Thus, the housing is held stably.

In the innerphone of about the same size as the auricle, the support comprises a hook having a fixed shape, for example, in the letter 'C' (C-shape), and a fixed size. The hook touches a constricted part between the head and the auricle, so as to embrace in a C-letter-surrounded space the constricted part; the constricted part being attaching the auricle to a temporal bone of the user's head. Then, the support and the housing cooperatively pinch the auricle. Thus, the comparatively large housing is held on the face of the auricle stably without the type of headband that the headphone has.

The innerphone is generally so small and light, because of having no headbands, that the feeling of mounting the innerphone is better than that of the headphone. In addition, the innerphone requires only a small storage space and is handy for carring.

However, in the type of innerphone with its housing inserted into the cavity of the auricle, the size of the housing cannot be made larger than the cavity in the center part of the auricle near the earhole. Thus, the speaker unit cannot be made larger. Therefore, the low tones reproduced by the innerphone have less dynamism than those reproduced by the headphone.

This disadvantage of the poor quality of the low tones is overcome in the type of innerphone wherein the housing is held by the cooperation of the housing and the support with holding the auricle therebetween.

In this conventional type of innerphone, however, since the hook of the support is only hung on the constricted part of the auricle, the support itself is not always held on the constricted part stably. Accordingly, the feeling of mounting the innerphone is not good. Moreover, since the housing tends to slip off the right position, a gap between the housing and the face of the auricle is liable to be formed. Through this gap, the reproduced sounds from the speaker unit leak out of the ear and the outside noises enter the ear. As a result, in the above-mentioned type of innerphone, quality of the reproduced sounds deteriorates. In addition, in the above-mentioned type of innerphone, the shape of the hook is fixed and cannot be changed. On the other hand, the widths of the constricted parts of the auricles are various among the users. Therefore, in the conventional innerphone with the constant shape and size, there can be a case that the size of the hook does not fit the width of the constricted part of the auricle. In that case, not only the feeling of mounting the innerphone, but also the quality of the reproduced sounds are not good, since the housing is out of the right position.

In addition, in the case of the housing of substantially the same size as the auricle, such as the conventional housings of the headphone and the above-mentioned type innerphone, a face of the housing to contact the face of the auricle is substantially flat. Thus, when mounting such the housing on the auricle, a gap between the flat face and the auricle's face is formed. Through the gap, the reproduced sounds from the speaker unit leak out of the ear and the outer noises enter the ear. Thus, the quality of the reproduced sounds, particularly of the high tones, is not satisfactory enough in the case of the conventional headphone.

SUMMARY OF THE INVENTION

An object of the present invention is to produce an innerphone type acoustic transducer which is put on by pinching a user's auricle between a housing and a support thereof in cooperation, wherein the support itself is held more stably than the conventional transducer. Thus, the acoustic transducer of the present invention has better quality of its reproduced sounds than that of the conventional headphone or the acoustic transducer, without lacking the advantages of the innerphone type, that is, (a) the better feeling of mounting it; (b) the less storage space; and (c) the better portability; than the conventional headphone.

In order to achieve the above object, an acoustic transducer of the present invention comprises a housing having an electroacoustic transducer;

a support comprising a hook (a) being for holding a constricted part of an auricle therewith, said constricted part attaching said auricle to the user's temporal bone of head, (b) having a substantial shape of the letter C (C-shape), and (c) having means for changing or adjusting a gap between an upper part and a lower part of the C-shape, said support being for supporting said housing on said auricle by gently-pinching said auricle in cooperation of and between said hook and said housing; and a connecting member connecting said housing and said support, in the manner that said housing and said support gently pinch said auricle therebetween.

The support of the acoustic transducer is mounted on the constricted part of the auricle stably by the hook. Moreover, the housing and the support are held by the auricle therebetween cooperatingly. In this manner, the acoustic transducer of the present invention is firmly mounted on the auricle. Accordingly, without a headband of the conventional type of headphone, the comparatively large housing is held on the auricle.

The support is mounted by that an upper part and a lower part of the hook in the C-shape embrace the constricted part of the auricle therein. Therefore, in comparison with a conventional case that a single hook in a constant shape is hung on the auricle such as a temple of glasses, the support of this invention is mounted on the auricle more stably.

Moreover, the user changes or adjusts the shape of the inside space of this hook in order to fit the width of the constricted part of the auricle. Thus, since the support itself is stably mounted on the auricle by the hook, the housing held on the auricle hardly slips off the holding position in comparison with the conventional case that the simple hook of a constant shape is hung on the auricle. Because of that, the feeling of mounting the innerphone is improved. In addition, quality of the reproduced sounds is prevented from deterioration caused by gaps between the housing and the face of the auricle.

Preferably, said connecting member comprises a gap-narrowing force generator for exerting a force to narrow a gap between said housing and said support. The force of this gap-narrowing force generator presses the housing against the face of the auricle. Thereby, the housing is mounted stably at a position to cover the auricle, and further substantially no gaps are formed between the housing and the auricle. In addition, the force can hold the comparatively large housing on the auricle, similarly as the conventional elastic force of the headband. Accordingly, since the speaker unit therein is made larger, and therefore the quality of the low tones reproduced thereby is improved.

In one preferred mode of the present invention, said connecting member (a) has a pivot which pivot-connects said housing and said support rotatably, and (b) changes or adjusts a gap between said housing and said support by a relative rotation of said housing and said support.

More preferably, said connecting member has a torque generator for exerting torque to narrow the gap between said housing and said support. In the acoustic transducer comprising the above-mentioned connecting member, the support is mounted on the constricted part of the auricle attaching the auricle to the head, and the torque of the torque generator makes the housing and the support press front and back faces of the auricle, respectively. Thus the housing is held at a position to cover the auricle.

In the acoustic transducer comprising the above-mentioned connecting member in one preferred mode, said housing and said support have first and second finger-push parts, respectively. Preferably, said housing or said support has a lever configuration, and therefore, said housing or said support rotates around said pivot when a relative force is applied between said first finger-push part and said second finger-push part. In that case, said first finger-push part is provided at a position opposite to said housing with respect to said pivot, or said second finger-push part is provided at a position opposite to said hook with respect to said pivot. Said first finger-push part or said second finger-push part is a recess or a protuberance. In any mode mentioned above, when, for instance, a thumb and a first finger of the same hand touch the first and second finger-push parts, respectively, and apply forces on the finger-push parts to decrease a distance between the two fingers, the gap between the housing and the support are widened by the leverage. Moreover, in the case that the torque generator is provided, the widened gap between the housing and the support is narrowed by the torque of the torque generator when the forces of the fingers are reduced or removed. Thus, the acoustic transducer of the present invention is easily mounted on the constricted part of the auricle by only one hand by that the housing or the support is constructed as a lever.

Preferably, said support has a second gap-narrowing force generator for exerting a force to narrow a gap between said upper part and said lower part of said C-shaped hook. Thus, the hook embraces the constricted part of the auricle in the space within the C-shape, and the second gap-narrowing force generator exerts a force to prevent the gap between the upper and lower parts of the C-shape from being widened. Accordingly, the stability of the support itself is improved.

The above-mentioned support in one preferred mode comprises (a) a first hook and a second hook arranged to face each other;

(b) a second pivot which rotatably pivot-connects said first hook and said second hook, in the manner that said first hook or said second hook can rotate around said second pivot and can change or adjust a gap between said first hook and said second hook; and (c) a second torque generator for exerting torque to narrow said gap between said first hook and said second hook.

The above-mentioned support is stably mounted because the torque of the second torque generator makes the first and second hooks press the constricted part of the auricle.

The above-mentioned support in another preferred mode comprises (a) a first hook and a second hook arranged to face each other; and (b) an elastic member connecting said first hook and said second hook for exerting an elastic force to narrow a gap between said first hook and said second hook.

The above-mentioned support is stably mounted by that the elastic force of the elastic member makes the first and second hooks press the constricted part of the auricle therebetween. Moreover, the first and second hooks and the elastic member may be formed as one body.

The above-mentioned support in still another preferred mode comprises (a) a first hook and a second hook arranged to face each other; and (b) a slider which slidably connects said first hook and said second hook;

said slider being for changing or adjusting a gap between said first hook and said second hook by sliding of said first hook or said second hook. The above-mentioned support is stably mounted since the slider is fixed in a condition that the first and second hooks are pressed against the constricted part of the auricle therebetween.

Preferably, said housing has roughly the same size as said auricle. In the acoustic transducer of the present invention, the housing and the support are mounted by pinching the auricle therebetween in cooperation. Thereby, the size of the housing of this invention can be made larger than that of the conventional innerphone, without a headband of the conventional type of headphone. In the case of the housing having such a large size, the speaker unit in the housing can be made larger. Accordingly, the quality of the reproduced low tones can be improved.

Preferably, a front of said housing is convex at a center part which emits sounds from the electroacoustic transducer. When the above-mentioned housing is mounted in such manner that the front thereof faces the earhole, the front of the housing, more preferably an earpad which covers the front, and the face of the auricle touch each other substantially without gaps therebetween because the center part of the front of the housing is convex. Thus, not only the reproduced sounds from the speaker unit does not leak out, but also noises does not enter the ear from the outside. Therefore, the quality of the reproduced sounds, especially of the high tones, is improved. Since the center part of the front of the housing touches the face of the auricle, the housing hardly slips off the position, wherein the housing faces the earhole. Thus, the acoustic transducer of the present invention is mounted on the auricle more stably than the conventional ones. Accordingly, not only the feeling of mounting it but also the reproduced sounds are improved, since the gap between the front of the housing and the auricle are kept small.

In a case that one or more cords are provided for connecting electrically said electroacoustic transducer and an outside acoustic signal generating apparatus, it is preferable to have at least one or more recesses or protuberances on an opposite part of said support to said housing, namely a part near the temporal bone; or alternatively, on an opposite part of said housing to said support for the following reason. In order to store or carry the acoustic transducer unit(s) of the present invention, said cords are wound in a manner to bind two acoustic transducer units putting one upon the other, or just around said acoustic transducer unit, and said recesses or protuberances firmly hold said wound cord. Accordingly, the wound cords hardly become loose. Therefore, the storage space of the acoustic transducer is small and its portability is good.

In the acoustic transducer of the present invention, preferably a part of said support for touching said constricted part is made of soft material, such as urethane resin or urethane sponge. Thus, when the acoustic transducer of the present invention is mounted on the auricle, the feeling of mounting it is improved.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

The following is an explanation for the best embodiments of the present invention, by reference to some preferred examples therein.

EXAMPLE 1

Figure 1:
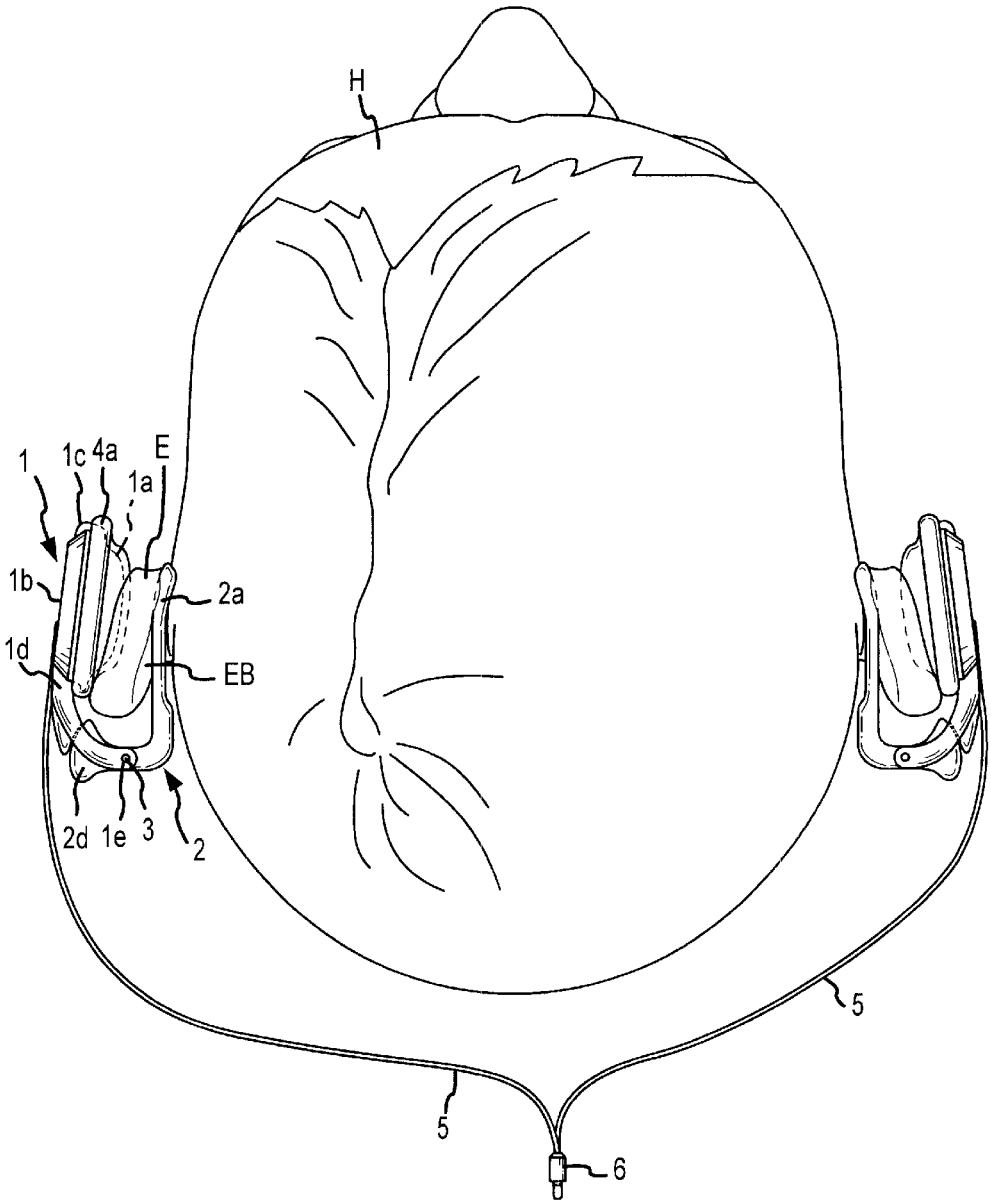
FIG. 1 is a top view of a user's head H with the acoustic transducer of Example 1 of the present invention mounted on the user's auricles E.

FIG. 1 shows an acoustic transducer of Example 1 of the present invention as mounted on both auricles E on both sides of a user's head H. The acoustic transducer comprises a housing 1 and a support 2 connected to the housing 1 by a first pivot 3 in a link 1*d*.

As shown in FIG. 1, the acoustic transducer is mounted in such a way that the support 2 is hung on a constricted part EB of the auricle E, and that the housing 1 and the support 2 pinch the auricle E therebetween in cooperation. The acoustic transducers mounted on both of the auricles E are electrically connected to an outside acoustic reproducing apparatus by cords 5 and a plug 6, from which acoustic signals are inputted.

Figure 2:
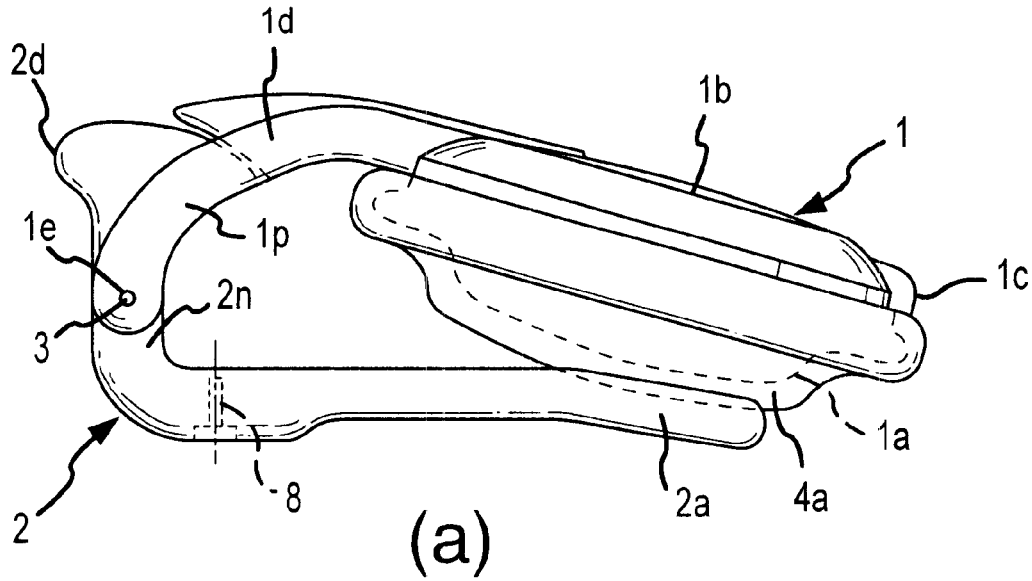
FIG. 2 shows top views of the left unit of the acoustic transducer of Example 1, wherein (a) and (b) are top views, respectively, with the minimum and maximum gap size between the housing 1 and the support 2, respectively.
Figure 2:
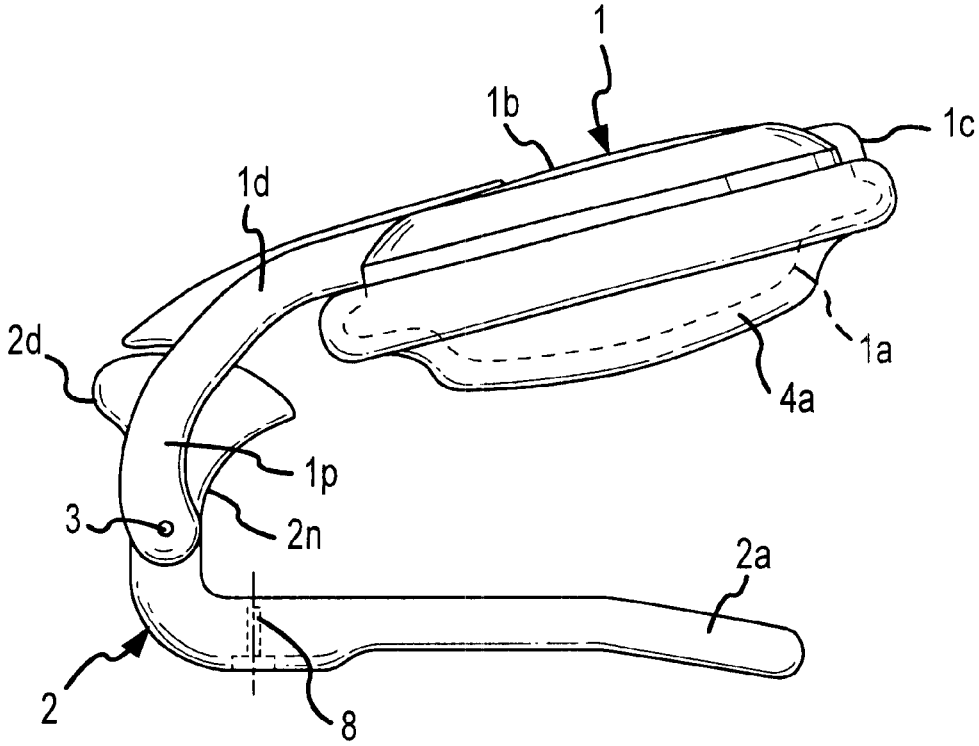
Figure 3:
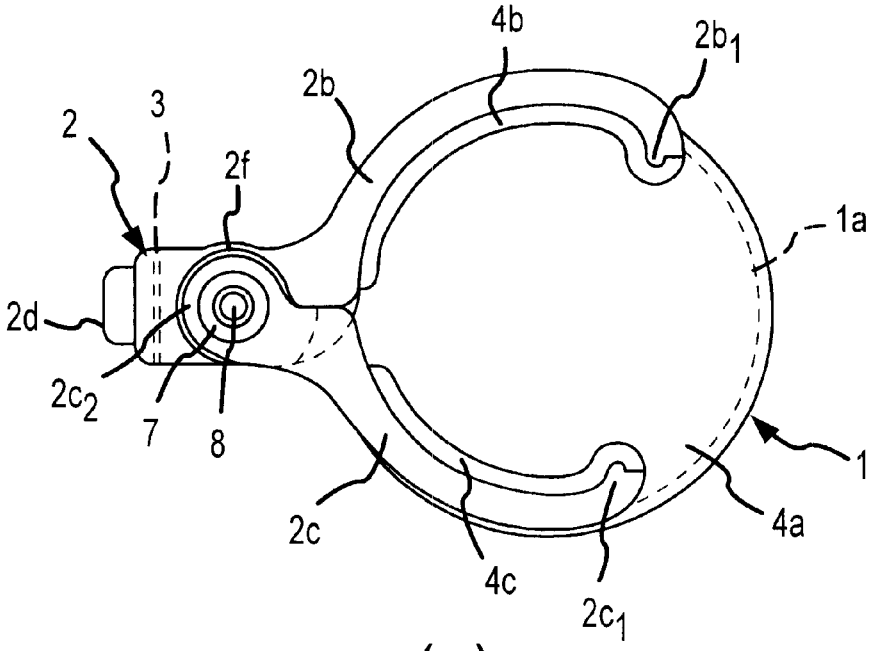
FIG. 3 shows front views of the left unit of the acoustic transducer of Example 1, wherein (a) and (b) are front views, respectively, with the minimum and maximum gap size between the first hook 2*b* and the second hook 2*c*.
Figure 3:
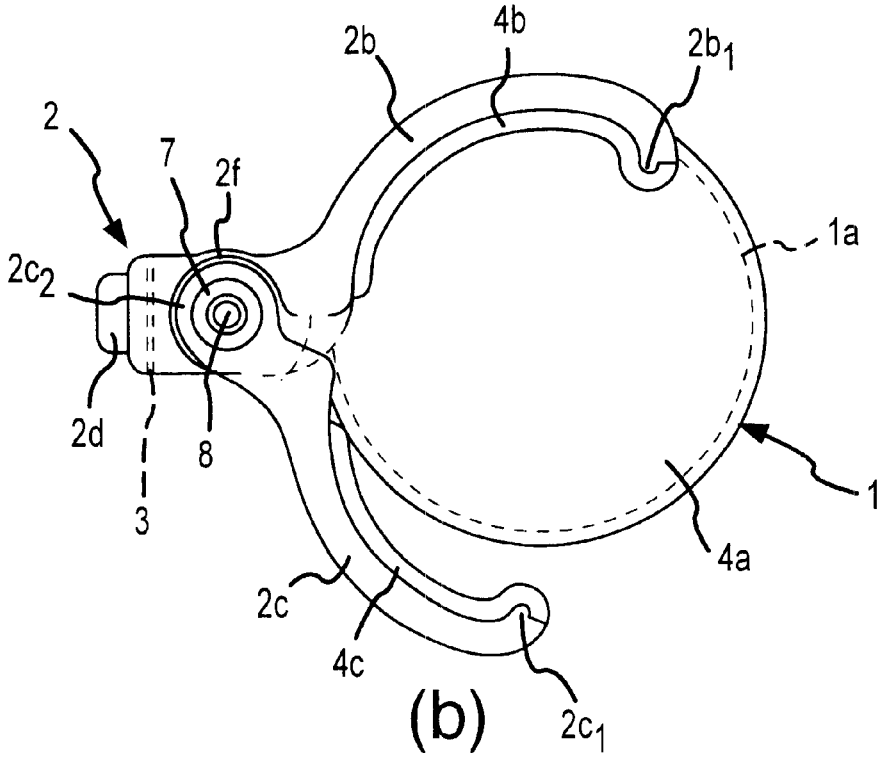
Figure 4:
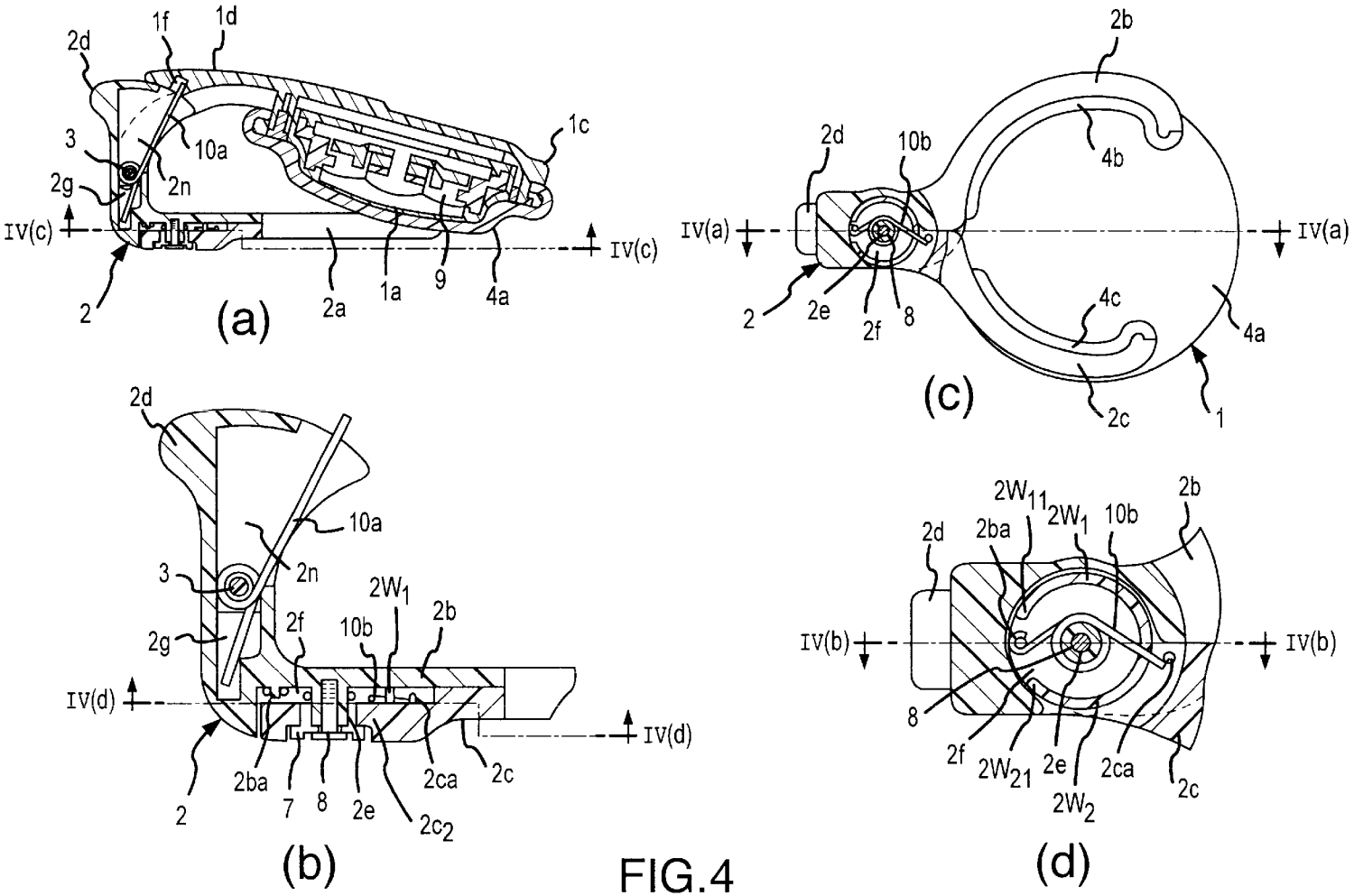
FIG. 4 shows partially sectioned top views of the left unit of the acoustic transducer of Example 1, wherein (a) is a top cross sectional view of the left unit, (b) is an enlarged cross sectional view of a portion of (a), (c) is a front cross sectional view showing a partially cross section of the left unit, and (d) is an enlarged cross sectional view of a portion of (d).

FIGS. 2, 3 and 4 show a part mounted on a left auricle of the acoustic transducer (left unit) of Example 1 of the present invention. For the sake of the convenience, The following is mainly an explanation for components of this left unit. A part mounted on a right auricle (right unit) is of a construction symmetric with this left unit.

Figure 5:
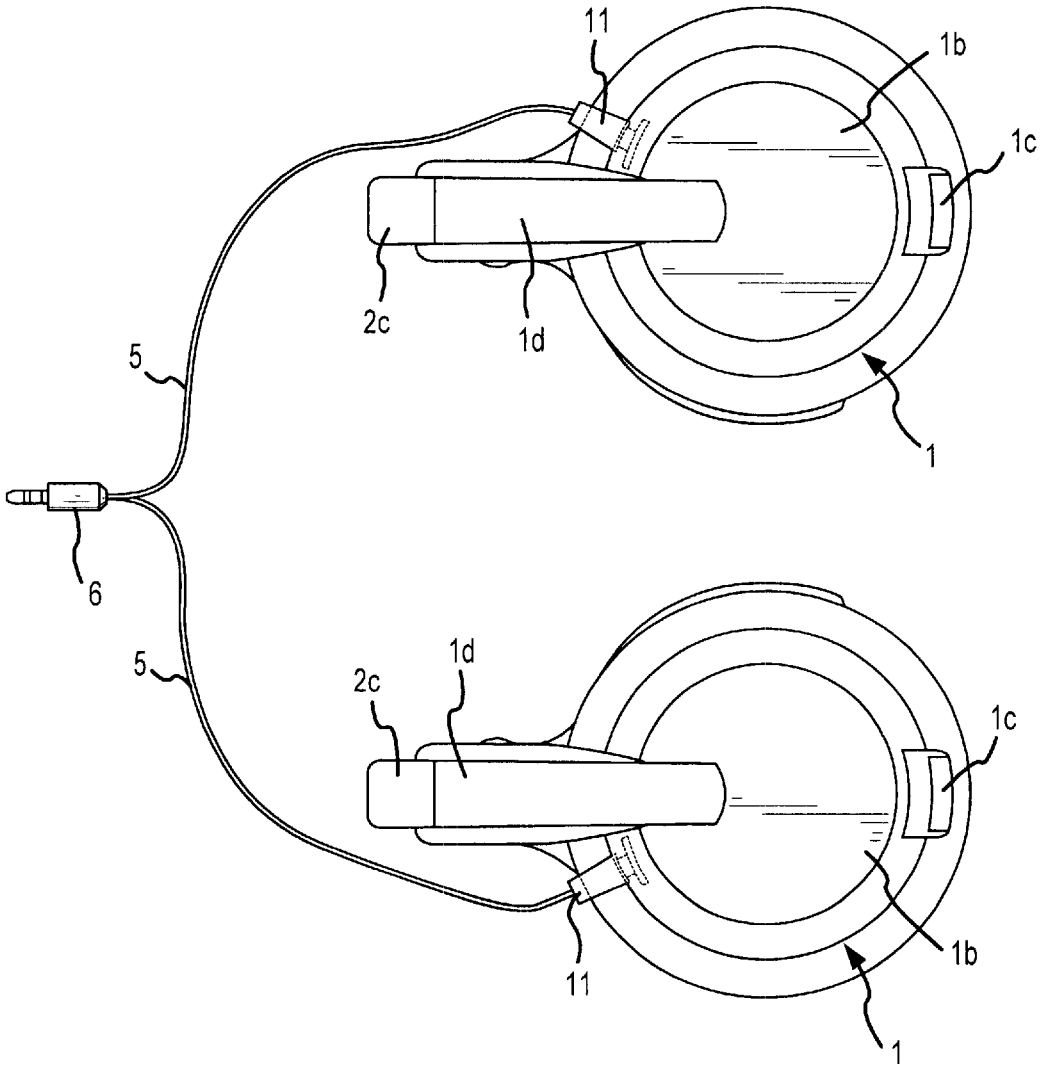
FIG. 5 shows a rear view of the acoustic transducer of Example 1.

The housing 1 is made of, preferably, ABS resin. As shown in FIG. 2, the housing 1 comprises a front 1*a* which faces the auricle when mounted thereon, a side shaped like a short circular cylinder with its height considerably shorter than a diameter of a front, and a back 1*b* opposite to the front 1*a*. The front 1*a* of the housing 1 has a convex center part and an earpad 4*a*. The earpad 4*a* is made of a soft and porous synthetic resin, and covers the front 1*a*. The size of the front 1*a* is substantially the same as that of the auricle. There are a first finger-push part 1*c* and a link 1*d* on the back 1*b* of the housing 1. The first finger-push part 1*c* is a protuberance on an edge part of the back 1*b* of the housing and is capable of being pressed by a finger toward the center of the housing 1. The link 1*d* is made of, preferably, ABS resin. The link 1*d* continues in substantially parallel with the back 1*b* from the edge part of the back 1*b* opposite to the first finger-push part 1*c* towards the outside of the housing 1. From the back 1*b* to the outside in the direction towards the back part of the head, the link 1*d* curves slightly towards the side of the front 1*a*. The curved tip 1*p* are formed into two branches, each of which has a hole 1*e* for a first pivot 3 put therethrough also through a hole of the support 2. As shown in FIG. 2, the support 2 is inserted between the branches of the link 1*d*. Moreover, as shown in FIG. 5, in an edge part of the back 1*b*, a bushing 11 is installed for passing the cord 5 therethrough towards the inside of the housing 1. The bushing 11 is made of soft synthetic resin.

The support 2 shown in FIG. 2 is made of, preferably, ABS resin, and has parts 2*a* opposite to the front 1*a* of the housing 1 and a bent part 2*n* which is bent towards the housing 1. The part 2*n* is inserted between the branching parts 1*p* at the tip of the link 1*d*. The tip of the bent part 2*n* has a second finger-push part 2*d* which is formed as a protuberance for touching by a finger so as to push and turn the support 2 towards the housing 1.

The first pivot 3 is, preferably, a metallic pin. The first pivot 3 is put through the hole 1*e* in the branches 1*p* of the tip of the link 1*d* and the hole in the part of the support 2 inserted between the branches 1*p*. This first pivot 3 rotatably connects the housing 1 and the support 2. Since the support 2 connected to the housing 1 can rotate around the first pivot 3, a gap between the front 1*a* of the housing 1 and the opposite part 2*a* of the support 2 to the front 1*a* can be changed. FIG. 2(*a*) shows the state of the minimum gap therebetween, and FIG. 2(*b*) shows the state of the maximum one.

FIG. 3 shows front views of the left unit from a forward direction of the front 1*a* of the housing 1. As shown in the figure, the support 2 comprises a first hook 2*b* and a second hook 2*c* of arc shapes. The shape of the arc is roughly along the circular periphery of the housing 1. The first hook 2*b* and the second hook 2*c* are arranged so that their respective insides of the arc shapes face to each other. The tips of the arcs of the first hook 2*b* and the second hook 2*c* each bend slightly towards the insides of the arc and have round ends $2b_1$ and $2c_1$. The second hook 2*c* is slightly shorter than the first hook 2*b*. The insides of the arcs of the first hook 2*b* and the second hook 2*c* are equipped with a first soft member 4*b* and a second soft member 4*c*, respectively, which are made of elastomer. Also rubber can be used as the soft members.

One end of the first hook 2*b* has a circular cavity 2*f*. One end $2c_2$ of the second hook 2*c* has a circular shape with a little less diameter than the cavity 2*f*. The end $2c_2$ is put into the cavity 2*f*, such that a hole at the center of the end $2c_2$ and the center of the cavity 2*f* are set in the same position. On the front of the end $2c_2$ of the second hook 2*c*, there is a circular cavity which is concentric with the end $2c_2$of the second hook 2*c*. A second pivot 7 in the horizontal position is put into the circular cavity of the second hook 2*c* and is fixed by a screw 8 which is screwed on the first hook 2*b*. Since the second hook 2*c* can rotate around the second pivot 7, the gap between the respective insides of the arcs of the first hook 2*b* and the second hook 2*c* can be changed. FIG. 3(*a*) shows the case with the minimum gap therebetween and FIG. 3(*b*) shows the case with the maximum gap, respectively.

FIG. 4(*a*) is the cross sectional view of the left unit shown in FIG. 2(*a*) taken in the line IV(*a*)—IV(*a*) of the front view FIG. 4(*c*). A speaker unit 9 provided in the housing 1 emits reproduced sounds out through many holes of a speaker plate fit into the front 1*a*.

FIG. 4(*b*) is the enlarged view of FIG. 4(*a*) near the first pivot 3 in the vertical position. As shown in FIGS. 4(*a*) and (*b*), the support 2 has a cavity 2*g* in the part 2*n* inserted between the branches of the link 1*d*. In the cavity 2*g*, there is the first pivot 3 and a first spring 10*a* is wound around the first pivot 3. The first spring or the gap-narrowing force generator 10*a* gently pinches the auricle by and between the housing 1 and the support 2. One end of the first spring 10*a* is caught inside the cavity 2*g* in the support 2, and the other end thereof is inside a cavity 1*f* at a branching point of the link 1*d*, respectively. When a gap between the front 1*a* of the housing 1 and the opposite part 2*a* of the support 2 to the front 1*a* is formed, a restoring force of the first spring 10*a* applies torque to the housing 1 and the support 2 so as to narrow the gap.

FIG. 4(*c*) is a partial cross sectional front view of the left unit shown in FIG. 3(*a*) taken in the line IV(*c*)—IV(*c*) of FIG. 4(*a*). FIG. 4(*d*) is the enlarged view of FIG. 4(*c*) near the second pivot 7. At the center of the circular cavity 2*f* of the first hook 2*b*, there is a protuberance 2*e* shaped in a circular cylinder coaxial with the circular cavity 2*f* of the first hook 2*b*. A second spring 10*b* is wound around the protuberance 2*e*. On the protuberance 2*e*, as shown in FIG. 4(*b*), the second pivot 7 is fixed by the screw 8. The second pivot 7 rotatably pivot-connects the second hook 2*c*. One end of the second spring 10*b* is caught on a protuberance 2*ba* of the first hook 2*b* in the circular cavity 2*f*. The other end of the second spring 10*b* is caught on a protuberance 2*ca* of the second hook 2*c* on the side facing the first hook 2*b*; the circular end $2c_2$ (FIG. 4(*b*)) of the second hook 2*c*, which circular end $2c_2$ is put into the circular cavity 2*f* of the first hook 2*b*, has the protuberance 2*ca*. The circular end $2c_2$ (FIG. 4(*b*)) of the second hook 2*c* has a first wall $2w_1$ and a second wall $2w_2$ as shown in FIG. 4(*d*), substantially along the circumference of the circular end $2c_2$on the side facing the first hook 2*b*. One end of the first wall $2w_1$ and one end of the second wall $2w_2$ fix the second spring 10*b* near the protuberance 2*ca*. The other end $2w_{11}$ of the first wall $2w_1$ or the other end $2w_{21}$ of the second wall $2w_2$ is put in such a position as to touch the protuberance 2*ba* moving due to the rotation of the second hook 2*c* around the second pivot 7, in order to prevent the second hook 2*c* from rotating and limit a range of the rotation angle. According to the above-mentioned construction, the restoring force of the second spring 10*b* applies torque to the first hook 2*b* and the second hook 2*c* so as to narrow the gap.

Figure 6:
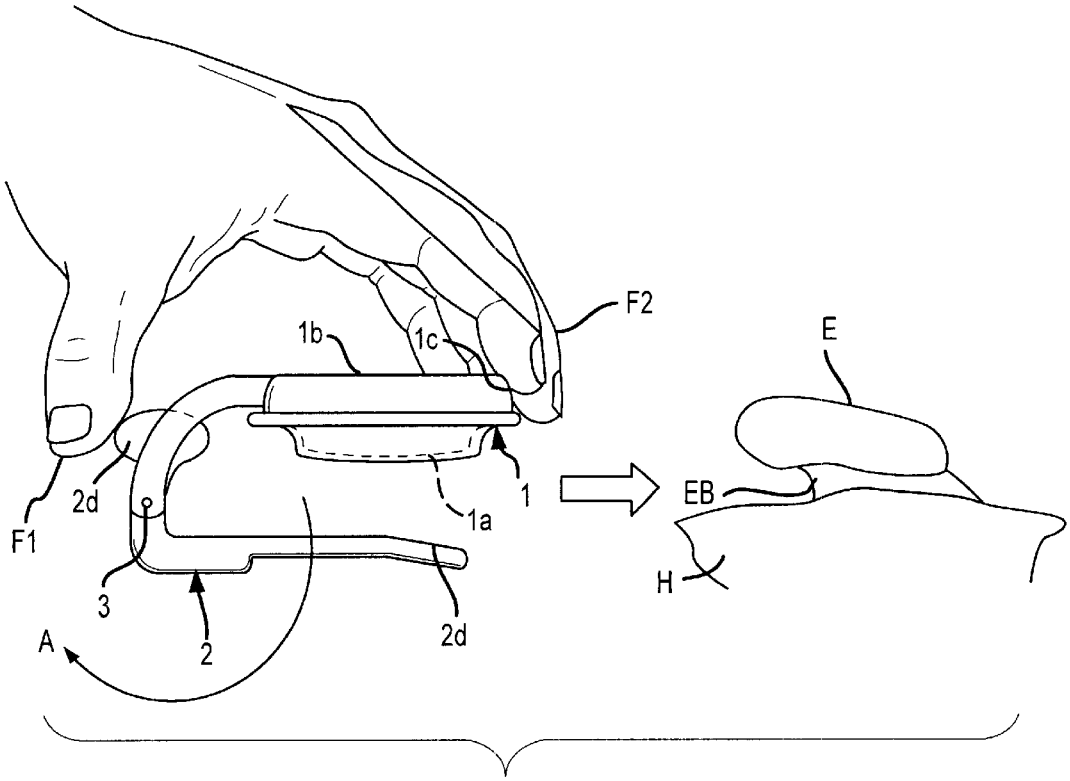
FIG. 6 shows top views of the left unit of the acoustic transducer of Example 1 illustrating how to mount it on the left auricle E, wherein (a) is a top view with the gap between the housing 1 and the support 2 widened by the two fingers applying relative forces between the first finger-push part 1*c* and the second finger-push part 2*d* before mounting, and (b) is a top view of the left unit after being mounted.
Figure 6:
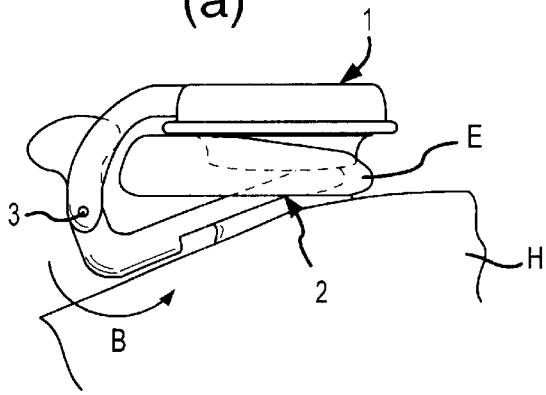

We will explain how the left unit of the above-mentioned construction is mounted on the auricle of the left ear with reference to FIG. 6. As shown in FIG. 6(*a*), at first, the first finger or the second finger F2 of the left hand is touched to the first finger-push part 1*c* on the back 1*b* of the housing 1, and the thumb F1 of the same hand is touched to the second finger-push part 2*d*. Next, forces are applied to the first finger F2 and the thumb F1 so as to narrow a gap between both the fingers. Then, because of the leverage, the support 2 rotates clockwise around the first pivot 3 towards a direction of an arrow A in FIG. 6(*a*) widening the gap between the front 1*a* of the housing 1 and the opposite part 2*a* of the support 2 to the front 1*a*. In order to put the auricle E between this gap, the left unit is approached to the auricle E from the position behind and above the auricle E. As shown in FIG. 3, the first hook 2*b* is slightly longer than the second hook 2*c*. Moreover, a gap between the tips $2b_1$ and $2c_1$ of the arcs, which tips are curving slightly inside the arcs is at least wider than a width of the constricted part EB of the auricle E (FIG. 6). Therefore, the left unit can be approached to the auricle E such that, when the first soft member 4*b* of the first hook 2*b* touches the upside of the constricted part EB, then the tip $2c_1$ of the arc of the second hook 2*c* touches the downside of the constricted part EB.

When the tip $2c_1$ of the arc of the second hook 2*c* is pressed against the downside of the constricted part EB, the second hook 2*c* slightly rotates around the second pivot 7, by being pressed by the downside of the auricle. And, as shown in FIG. 3(*b*), the gap between the first hook 2*b* and the second hook 2*c* becomes wider. Meanwhile, the tip $2c_1$ , of the arc of the second hook 2*c* slides down along on the surface of the constricted part EB.

After placing the front 1*a* of the housing 1 to the place to cover the auricle E so that the earhole comes substantially to the center of the housing, the forces between the thumb F1 and the first finger F2 are diminished. Then, by the restoring force of the first spring 10*a* wound around the vertical first pivot 3 rotates the support 2 in the direction of an arrow B (FIG. 6(*b*)) towards the housing 1. Then, the front 1*a* of the housing 1 and the opposite part 2*a* of the support 2 to the front 1*a* pinch the auricle E in cooperation. Thus, without aid of a headband of the conventional type of headphone, the comparatively large housing 1 of similar size to the auricle E, is mounted on the auricle E At that time, by the restoring force of the second spring 10*b* wound around the protuberance 2*e* shown in FIG. 4, the first hook 2*b* and the second hook 2*c* press the constricted part EB. Particularly, the tips $2b_1$ and $2c_1$ of the arc of the first hook 2*b* and the second hook 2*c* each have the bending parts towards the constricted part EB. Therefore, even when the housing 1 tends to dislocate and rotate around the constricted part EB by an external force applied to the housing 1 due to, for example, pulling by the cord, the bending parts catches the constricted part EB and prevent the housing 1 from slipping out of position. Thus, the support 2 is stably mounted on the constricted part EB.

Moreover, since the first hook 2*b* and the second hook 2*c* have the first and second soft members 4*b* and 4*c* at their parts for touching the constricted part EB, the feeling of mounting the acoustic transducer of the first hook 2*b* and the second hook 2*c* on the constricted part EB is good.

Figure 7:
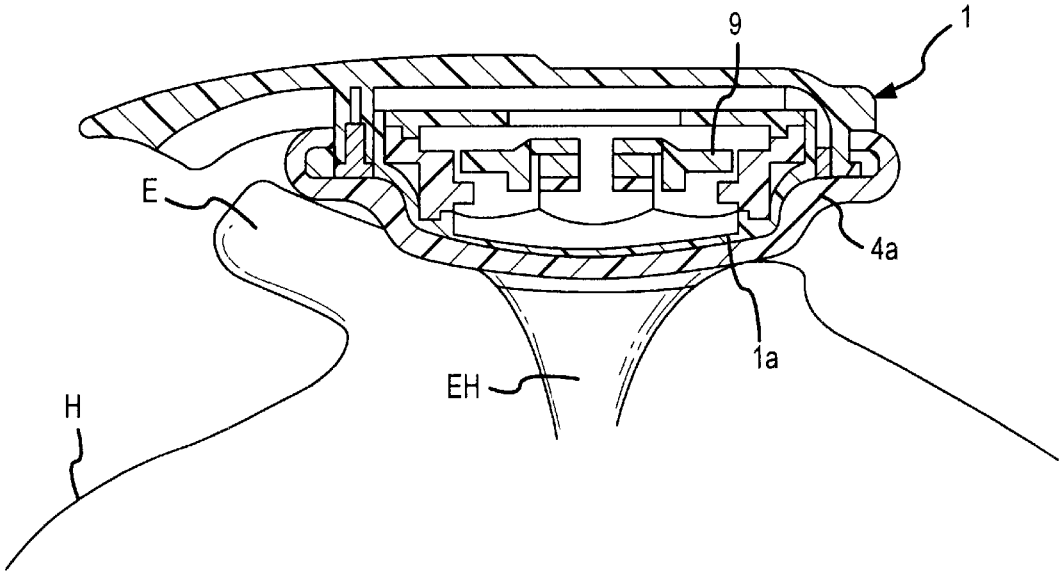
FIG. 7 is a-cross sectional plan view showing the relative position of the hosing 1 to the auricle E when the acoustic transducer of Example 1 is mounted.

In addition, since the center part of the front 1*a* has a convex shape, not only the edge parts of the front 1*a* but also the central part are pressed against the face of the auricle E. Thus, the housing 1 does not easily slip out of position along the face of the auricle E. Moreover, the earpad 4*a* covering the front 1*a* efficiently fills the gap between the front 1*a* and the face of the auricle E substantially with no space. FIG. 7 shows a position of the housing 1 with respect to the auricle E in the above-mentioned case. The front 1*a* of the housing 1 gently presses the inside of the auricle E with putting the earpad 4*a* therebetween. Thus, the front 1*a* gives the inside of the auricle E the good feeling of mounting the acoustic transducer. Since the front 1*a* is convex towards the inside space of the earhole EH, a contacting area between the earpad 4*a* over the front 1*a* and the inside of the auricle E is larger than that of the conventional headphone.

Figure 12:
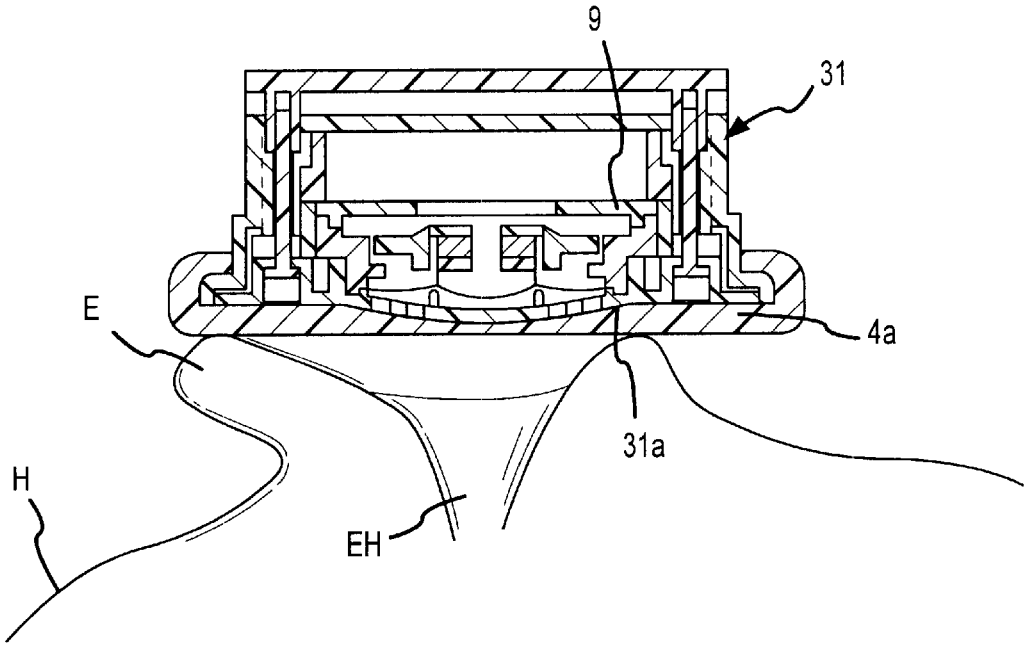
(PRIOR ART) FIG.12
FIG. 12 is a top cross sectional view of the head H showing the relative position of a housing 31 to the auricle E when the conventional headphone is mounted.

FIG. 12 shows a position of a housing 31 with respect to the auricle E in the case of mounting the conventional headphone on the auricle E. In the conventional headphone, a front 31*a* of the housing 31 is substantially flat so that a contacting area between the earpad 4*a* over the front 31*a* and the inside of the auricle E is not sufficient in comparison with that of the acoustic transducer of the present invention shown in FIG. 7. The larger this contacting area is, the narrower the gap between the front of the housing and the face of the auricle is; therefore, the harder the reproduced sounds from the speaker unit escape and the outside noises enter the ear. It is favorable to have a larger contacting area in order to improve the quality of the reproduced sounds. Thus, the acoustic transducer of the present invention is superior to the conventional headphone in the quality of the reproduced sounds.

In the acoustic transducer of Example 1, not only pinching of the auricle by the housing 1 and the support in cooperation, but also pinching of the constricted part of the auricle by the first hook 2*b* and the second hook 2*c* is carried out. Furthermore, the gap between the first hook 2*b* and the second hook 2*c* are changed by the restoring force of the second spring 10*b* as mentioned above, so as to fit the width of the constricted part of the user's auricle. Therefore, in comparison with the conventional support to hang on the constricted part of the auricle with a fixed or unchangeable shape, the support of Example 1 of the present invention can be fixed firmly and stably on auricles of different size and shape. As a result, the whole left unit of the acoustic transducer is mounted more stably than the conventional one. Since the stability of the acoustic transducer is high as mentioned above, not only the feeling of mounting it is improved, but also slipping out of the housing off the position hardly occur, the quality of the reproduced sounds is improved.

In the example shown in FIG. 3 and so on, the first hook 2*b* and the second hook 2*c* each have the shapes of the arcs. These shapes are, however, not essential for the present invention. These hooks may have another shapes, if the hooks can firmly pinch the constricted part in the mounting condition.

In FIGS. 1 and 5, the cords 5 and the plug 6 for connecting the speaker unit 9 to an outside acoustic signal generating apparatus are shown. These are, however, not essential components of Example 1, so the present invention should not be limited to such construction. It should be understood that acoustic transducers having no cords or plugs fall within a scope of the present invention, such as those having in the housing a radio receiving circuit, a transmitting and receiving circuit of a type of transceiver, a circuit for a hearing aid, an amplifying circuit, or an oscillating circuit.

EXAMPLE 2

Figure 8:
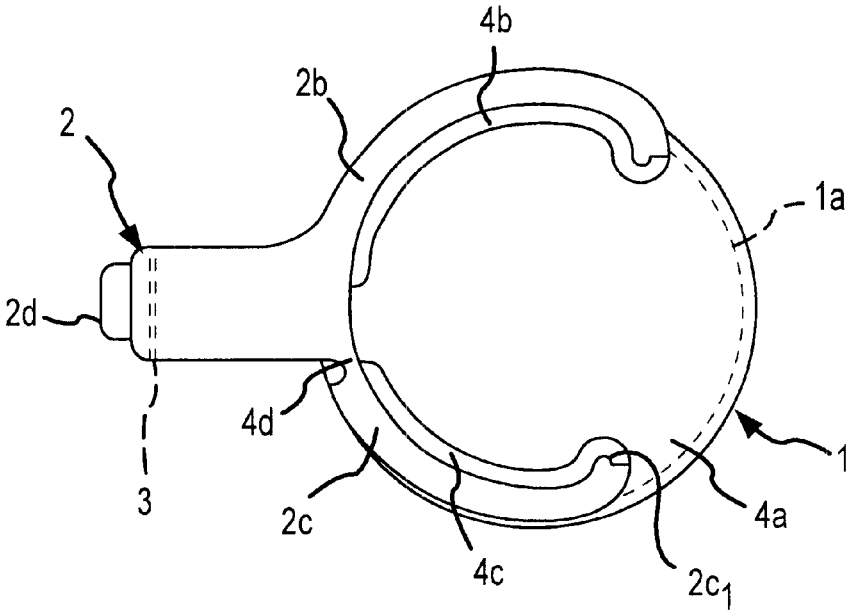
FIG. 8 shows front views of the left unit of the acoustic transducer of Example 2 of the present invention, wherein (a) and (b) are front views thereof before and after the elastic member 4*d* changes its shape, respectively.
Figure 8:
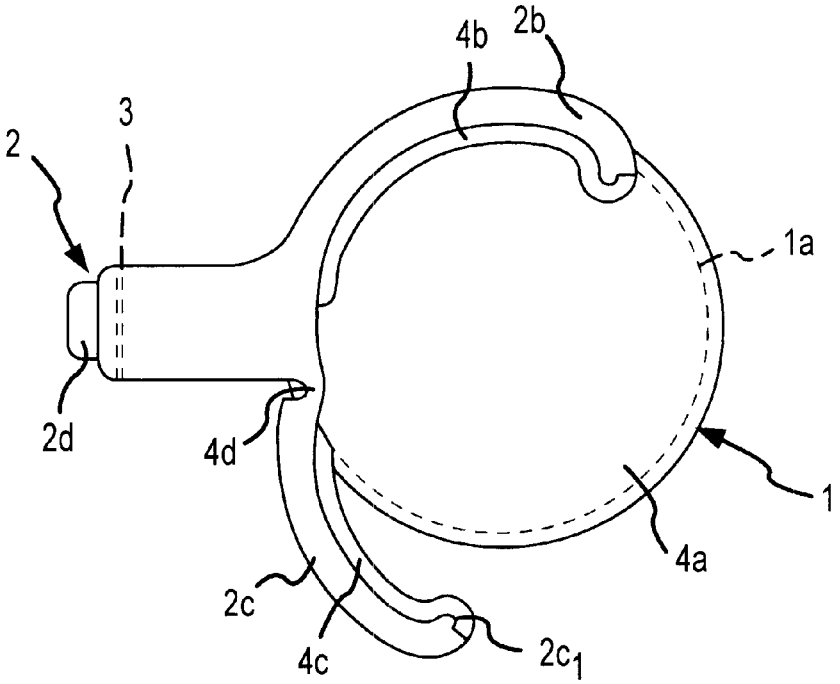

FIG. 8 is a front view of a left unit of Example 2 of the acoustic transducer of the present invention. A right unit has a construction symmetric with this left unit, just like Example 1. In Example 2, components similar to those in Example 1 are marked with the same marks as Example 1, and an explanation for those will be omitted.

A difference between Examples 1 and 2 is a point of connecting the first hook 2*b* and the second hook 2*c* by means of an elastic member 4*d*. The elastic member 4*d* is made of elastic body, such as elastomer. The elastic member 4*d* changes its shape when a stress is applied to it and restores its original shape when the stress is removed from it. In the case that no stress is applied, the elastic member 4*d* connects the first hook 2*b* and the second hook 2*c*, as shown in FIG. 8(*a*), so that both the hooks are roughly along the circular periphery of the housing 1. When the acoustic transducer of Example 2 is mounted on the auricle similarly to Example 1, and a tip $2c_1$ of an arc of the second hook 2*c* receives a force from the surface of the constricted part of the auricle, the elastic member 4*d* changes its shape for widening a gap between the first hook 2*b* and the second hook 2*c* shown in FIG. 8(*b*). When the constricted part of the auricle is put into the gap between the first hook 2*b* and the second hook 2*c*, an elastic force of the elastic member 4*d* makes the first hook 2*b* and the second hook 2*c* press the constricted part. Thus, just like Example 1, the support 2 is stably mounted on the constricted part. Accordingly, just like Example 1, the left housing 1 of the acoustic transducer is mounted stably, and therefore, the feeling of mounting the acoustic transducer and the quality of the reproduced sounds are improved.

While the first hook 2*b* and the second hook 2*c* each have the arc shapes shown in FIG. 8, just like Example 1, these shapes are not essential. Moreover, similarly to Example 1, the embodiment of Example 2 may be an acoustic transducer having no cords or plugs.

EXAMPLE 3

Figure 9:
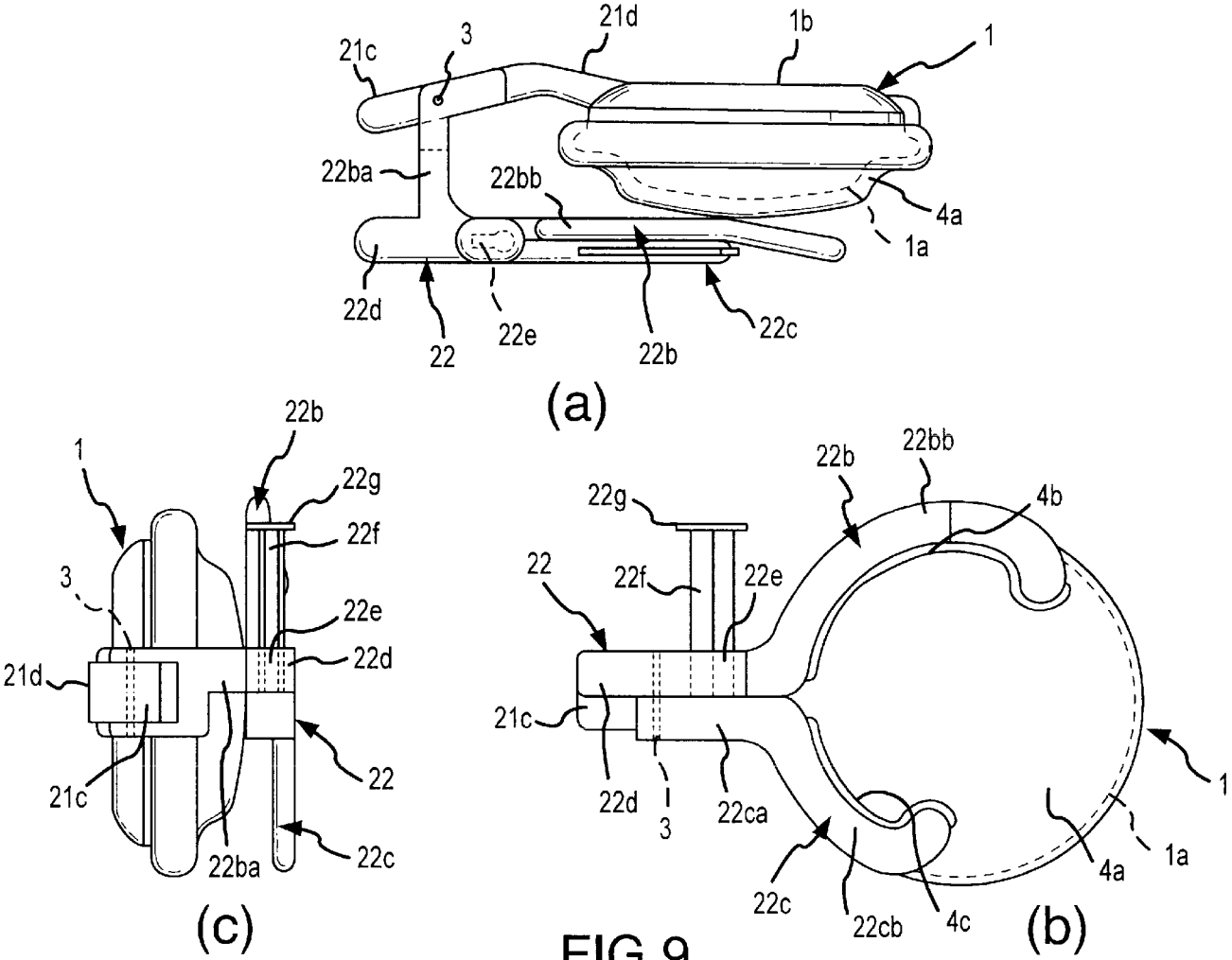
FIG. 9 shows views of the left unit of the acoustic transducer of Example 3 of the present invention, wherein (a) is the top view, (b) is the front view, and (c) is the side view.

FIG. 9 shows views of a left unit as Example 3 of the acoustic transducer of the present invention. Similar to Example 1, a right unit has a construction symmetric with the left unit. In Example 3, components corresponding or similar to Example 1 are marked with the same marks as those of Example 1, and explanation for those will be omitted.

A link 21*d* is made of ABS resin, similar to Example 1. The link 21*d* continues as shown in FIG. 9(*a*), from a back 1*b* of a housing 1 in a direction slightly inclined with respect to the parallel direction of the back 1*b*. Moreover, the link 21*d* curves forwards at a place where the link 21*d* continues to some length. A curved end of the link 21*d* has a hole for a pivot 3. In addition, an extended part of the link 21*d* still continuing outwards beyond the pivot 3 has a first finger-push part 21*c*.

A support 22 is made of ABS resin, similar to Example 1. The support 22 has a first hook 22*b* and a second hook 22*c* shown in FIG. 9. The first hook 22*b* comprises, as shown in FIG. 9(*a*), a substantially parallel part 22*bb* with the back 1*b* of the housing 1 and a substantially orthogonal part 22*ba*. End tip of the substantially orthogonal part 22*ba* divides into two branches as shown in FIG. 9(*c*), and the link 21*d* is inserted therebetween. This inserted part has a hole for the pivot 3 put therethrough. The pivot 3 is preferably a metallic pin and is put through this hole and the hole of the link 21*d*. This pivot 3 connects the housing 1 and the support 22. The rotation of the support 22 around the pivot 3 can change a gap between the front 1*a* of the housing 1 and the parallel part 22*bb* of the first hook 22*b* with the front 1*a*. Though omitted in FIG. 9, a return spring is wound around the pivot 3, similar to Example 1. A restoring force of this spring applies torque between the front 1*a* and the parallel part 22*bb* of the first hook 22*b* with the front 1*a* so as to narrow the gap, similar to Example 1.

The parallel part 22*bb* of the first hook 22*b* comprises a shape of the arc roughly along the circular periphery of the housing 1, as shown in FIG. 9(*a*), similar to Example 1. Moreover, a tip of the first hook 22*b* opposite to the part 22*bb* has a second finger-push part 22*d*. Between the arc-shaped part 22*bb* and the second finger-push part 22*d*, there is a hole 22*e* for a slider 22*f* put therethrough. This hole 22*e* has a shape of a keyhole for keeping the direction of the second hook 22*c*, preferably, as shown in FIG. 9(*a*). The second hook 22*c* has a shape of the arc roughly along the circular periphery of the housing 1, as shown in FIG. 9(*b*) similar to Example 1. The second hook 22*c* is arranged to face an inside of the arc to the first hook 22*b*. The second hook 22*c* has a slider 22*f* at a part 22*ca* touching the first hook 22*b* shown in FIG. 9(*b*). The slider 22*f* is made of, preferably, ABS resin. The slider 22*f* extends from one end fixed on the second hook 22*c* through the hole 22*e* of the first hook 22*b*. A tip of the slider 22*f* has a retainer 22*g* for keeping the slider 22*f* from falling off the hole 22*e*. The slider 22*f* can slide along the hole 22*e*. A cross section of the slider 22*f* has, as shown in FIG. 9(*a*), such a shape as the slider 22*f* just fits into the hole 22*e* of the first hook 22*b*. Thus, the second hook 22*c* slides in the manner of keeping the constant direction. It should not be understood that this cross sectional shape is limited to such a keyhole shape, but the cross sectional shape may be any other one as far as the second hook 22*c* cannot rotate around the hole 22*e*. On the surface of the slider 22*f* and the inside of the hole 22*e* of the first hook 22*b* touching the surface of the slider 22*f*, preferably, ratchets made of a known resilient plastics are equipped; this is for providing a frictional resistance to the sliding of the slider 22*f* towards a direction of widening the gap between the first hook 22*b* and the second hook 22*c*; the frictional resistance should be higher than that to the sliding towards the opposite direction. However, the detail of the ratchet is omitted in FIG. 9. Thus, in particular, the frictional resistance is obtained for preventing the gap between the first hook 22*b* and the second hook 22*c* from widening, and therefore the slider 22*f* is maintained in the sliding position and the gap keeps a predetermined width.

Figure 10:
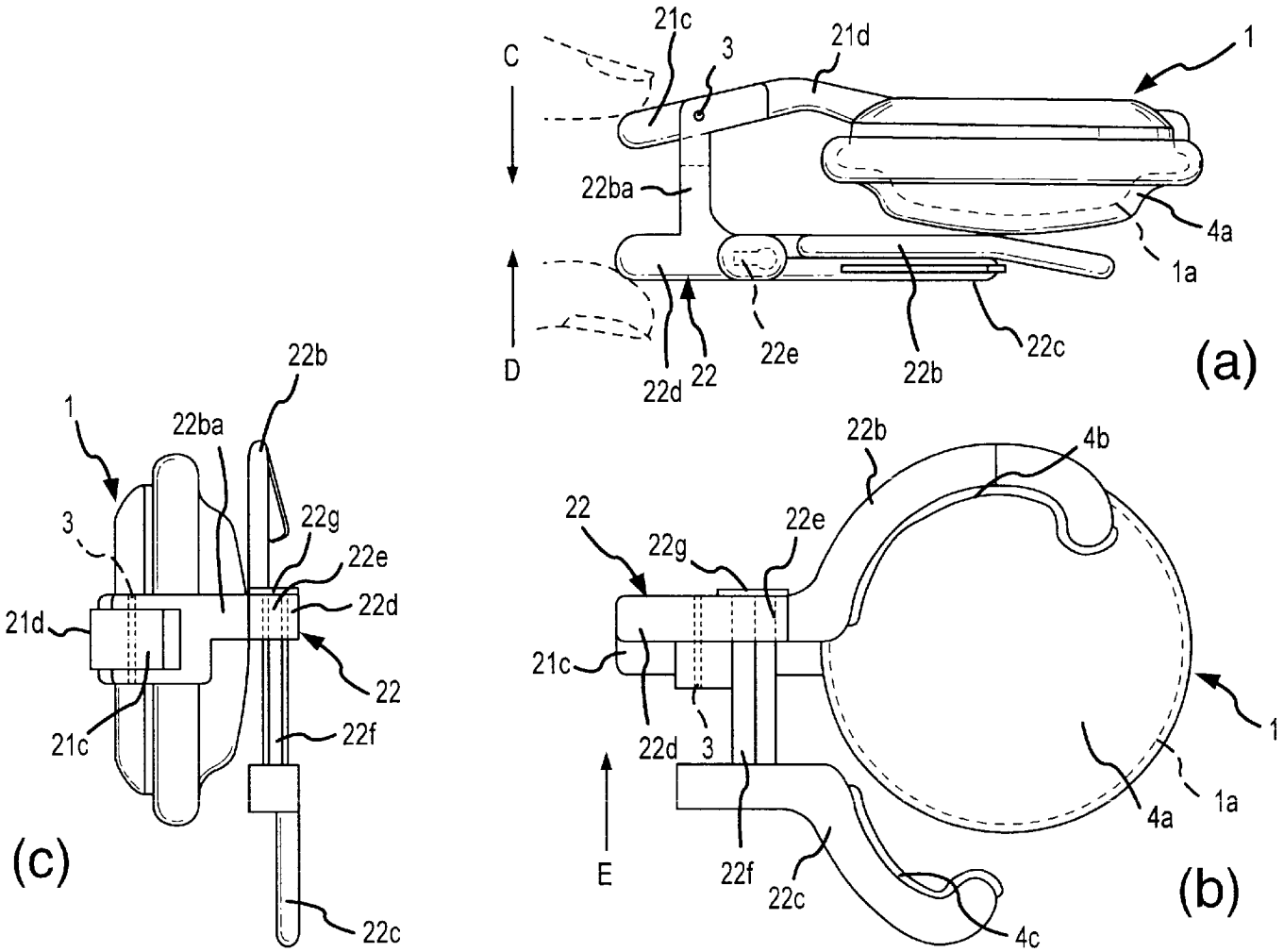
FIG. 10 shows views of the left unit of the acoustic transducer of Example 3, with the maximum gap size between the first hook 22*b* and the second hook 22*c*, wherein (a) is the top view, (b) is the front view, and (c) is the side view.

We will explain how to mount the acoustic transducer of Example 3 in accordance with FIG. 10, as follows. At first, the gap between the first hook 22*b* and the second hook 22*c* is widened by the sliding of the slider 22*f* along the hole 22*e*, as shown in FIG. 10(*b*), for allowing the constricted part of the auricle held therebetween. Next, as shown in FIG. 10(*a*), the first finger of the left hand is put on the first finger-push part 21*c* of the tip of the link 21*d* , and the thumb of the left hand is on the second finger-push part 22*d* of the tip of the first hook 22*b*, respectively. Then, a force is applied between the first finger in a direction of an arrow C shown in FIG. 10(*a*), and the thumb in a direction of an arrow D. At that time, because of the equipment of the first finger-push part 21*c* on the extended part of the link 21*d* outwards which extended part is beyond the pivot 3, a leverage of the link 21*d* causes the first hook 22*b* to rotate around the pivot 3, and the gap becomes wider between the front 1*a* of the housing 1 and the opposite part of the support 22 to the front 1*a*. After this left unit is approached to the auricle in such a position that the auricle is put between the above-mentioned gap, in a similar manner to Example 1, the force betweem both the fingers are reduced or removed. Then, just like Example 1, the support 22 rotates around the pivot 3 by the restoring force of the spring wound around the pivot 3, and the front 1*a* of the housing 1 and the opposite part of the support 22 to the front 1*a* pinch the auricle in cooperation. Finally, the second hook 22*c* is made to slide in a direction of an arrow E shown in FIG. 10(*b*) and a gap between the first hook 22*b* and the second hook 22*c* is narrowed. Thus, the support 22 is mounted stably on the constricted part. As a result, the whole unit also is stably mounted. Accordingly, just like Example 1 or Example 2, the left housing of the acoustic transducer is stably mounted on the auricle, and therefore, the feeling of mounting it and the quality of the reproduced sounds are improved.

While the first hook 22*b* and the second hook 22*c* shown in FIG. 9 have the shapes of the arcs, respectively, these shapes are not essential, just like Example 1. Moreover, similarly to Example 1, an acoustic transducer having neither cord nor plug falls within a scope of the present invention.

The construction of the connecting member for the housing and the support in the present invention should not be limited to that elucidated in Example 1 or Example 3. The construction of the connecting members of Example 1 and Example 3 are shown only as typical examples of the invention the connecting member of the invention may have other constructions which are capable of changing the gap between the housing and the support by one hand. For example, the construction of the connecting member for the link 21*d* and the support 22 in Example 3 may be replaced with the construction of Example 1 shown in FIG. 2. That is, similarly to Example 1, the first finger-push part may be provided on the edge part of the back 1*b* of the housing 1 which back 1*b* being at the position opposite to the link 1*d*, and the second finger-push part may be on the support 2 near the pivot 3. On the contrary, the construction of the connecting member for the link 1*d* and the support 2 in Example 1 or Example 2 may be replaced with the construction of Example 3 shown in FIG. 9. In this construction similar to Example 3, the first finger-push part may be equipped on the tip of the link 21*d*. In the case that the connecting member has the pivot, the direction of the pivot does not necessarily have to be substantially orthogonal to the direction of the second pivot 7 of Example 1 or the slider 22*f* of Example 3. The present invention functions effectively as far as the housing covers the auricle.

The first and second finger-push parts should not be limited to the protuberances shown in Example 1 or Example 3. For example, the first and second finger-push parts may be recesses having sizes for allowing a finger to enter there.

EXAMPLE 4

Figure 11:
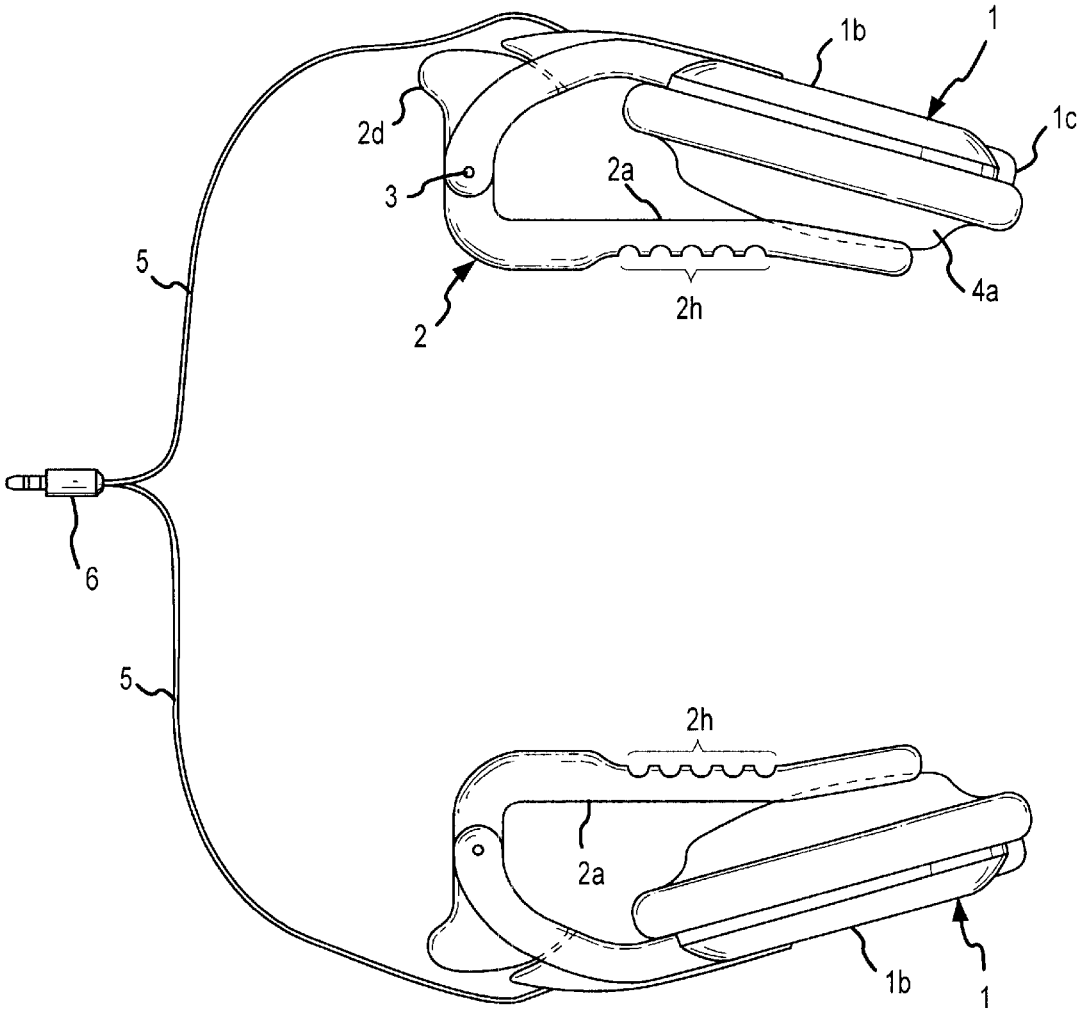
FIG. 11 is a top view of the acoustic transducer of Example 4 of the present invention.

FIG. 11 shows Example 4 of an acoustic transducer of the present invention. The housing of Example 4 is equipped with a plurality of recesses 2*h* as shown in FIG. 11 on an opposite part of the support 2 to the part 2*a* which contacts the auricle in Example 1 or Example 2 with cords 5.

When the acoustic transducer of Example 4 is stored or carried by the user, the housings 1 of the left and right units are disposed together by touching respective backs 1*b* and by winding the cords 5 around both units so as to be caught in the recesses 2*h* of the supports 2. Since the recesses 2*h* of the support 2 hold therein the wound cords 5, the wound cords 5 hardly loosen out of position. Accordingly, the housings 1 hardly slip from each other off the position of being wound. Therefore, for the acoustic transducer of Example 4 in the invention, it is easy to store and carry the acoustic transducer.

The case is similarly applicable to the acoustic transducer of Example 3 when it has the cords for connecting the speaker unit in the housing 1 and an outside acoustic signal generating apparatus. That is, as far as similar recesses to the recesses 2*h* of FIG. 11 are equipped on the opposite part of the link 21*d* to the support 2, just like Example 4 the left and right housings hardly slip from each other off position. Therefore, it is easy to store and carry the acoustic transducer of Example 3.

The position of the recesses for holding the cords should not be limited to the position elucidated in Example 4.

Alternatively, similar recesses may be provided on the backs of the housings and may hold the cords therein when the cords are wound around both units disposed together touching the fronts each other.

In another example, the recesses may be provided in any position that the recesses hold the cords therein when the cords are wound around both units disposed together touching the front of one unit and the back of the other unit.

In still another example, in the case that the cords of the housings are not connected each other, both the housing and the support of each unit may have the recesses, such that in each unit the cord does not loosen out of position when each of the cords is wound-around the unit.

It should be understood that the shapes and the number of the recesses are not limited to those shown in FIG. 11. An inside of the recess may have one or more corners. The number of the recesses may be even only one and the size thereof may be large. The acoustic transducer, wherein a plural of protuberances hold the cords wound as mentioned above in substitution for the recesses, falls within a scope of the present invention.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure.

Accordingly, it is intended that the appended claims be interpreted as covering all alterations and modifications as fall within the true spirit and scope of the invention.

What is claimed is:

1. An acoustic transducer, which comprises:

(A) a housing having an electroacoustic transducer;

(B) a support comprising a hook and adapted to support said housing on a user's auricle, said hook (a) having a substantial shape of the letter C, (b) having means for adjusting a gap between an upper part and a lower part of the C-shape, and (c) adapted to gently pinch a constricted part of the auricle, which attaches the auricle to the user's temporal bone of head, by embracing the constricted part in a space surrounded by the C-shape; and (C) a connecting member connecting said housing and said support, in the manner that said housing and said support gently pinch the auricle in cooperation, between the front of said housing and the C-shaped side of said hook.

2. An acoustic transducer in accordance with claim 1, wherein said connecting member comprises a gap-narrowing force generator for exerting a force to narrow a gap between the front of said housing and the C-shaped side of the hook.

3. An acoustic transducer in accordance with claim 1, wherein said connecting member (a) has a pivot which rotatably pivot-connects said housing and said support, and (b) adjusts a gap between the front of said housing and the C-shaped side of said hook by a relative rotation of said housing and said support.

4. An acoustic transducer in accordance with claim 3, wherein said connecting member has a torque generator for exerting torque to narrow said gap between the front of said housing and the C-shaped side of said hook.

5. An acoustic transducer in accordance with claim 3, wherein (a) said housing has a first finger-push part, (b) said support has a second finger-push part, (c) said housing or said support has a lever configuration, (d) said housing or said support rotates around said pivot when a relative force is applied between said first finger-push part and said second finger-push part.

6. An acoustic transducer in accordance with claim 5, wherein said first finger-push part is provided at a position opposite to said housing with respect to said pivot.

7. An acoustic transducer in accordance with claim 5, wherein said second finger-push part is provided at a position opposite to said hook with respect to said pivot.

8. An acoustic transducer in accordance with claim 1, wherein said hook has a second gap-narrowing force generator for exerting a force to narrow a gap between said upper part and said lower part of said C-shape.

9. An acoustic transducer in accordance with claim 1, wherein said hook comprises (a) a first hook and a second hook arranged to face each other as said upper part and said lower part, respectively;

(b) a second pivot which rotatably pivot-connects said first hook and said second hook, in the manner that said first hook or said second hook can rotate around said second pivot and can adjust a gap between said first hook and said second hook; and (c) a second torque generator for exerting torque to narrow said gap between said first hook and said second hook.

10. An acoustic transducer in accordance with claim 1, wherein said hook comprises (a) a first hook and a second hook arranged to face each other as said upper part and said lower part, respectively; and (b) an elastic member connecting said first hook and said second hook for exerting an elastic force to narrow a gap between said first hook and said second hook.

11. An acoustic transducer in accordance with claim 1, wherein said hook comprises (a) a first hook and a second hook arranged to face each other as said upper part and said lower part, respectively; and (b) a slider which slidably connects said first hook and said second hook, and is for adjusting a gap between said first hook and said second hook by sliding of said first hook or said second hook.

12. An acoustic transducer in accordance with claim 1, wherein said housing has roughly the same size as said auricle.

13. An acoustic transducer in accordance with claim 1, wherein said housing has a front having a convex center part.

14. An acoustic transducer in accordance with claim 1 comprising:

(a) a cord for connecting said electroacoustic transducer to an outside acoustic reproducer electrically; and (b) at least one recess or protuberance on a part of said support facing away from said housing, or alternatively, on a part of said housing facing away from said support;

said recess or protuberance holding said cord when said cord is wound around two of said acoustic transducers put one upon the other or one of said acoustic transducer so as to be caught in said recess or protuberance.

15. An acoustic transducer in accordance with claim 1, wherein a part of said support for touching said constricted part is made of soft material.

16. An acoustic transducer, which comprises:

(A) a housing having an electroacoustic transducer;

(B) a support including a hook and adapted to support said housing on a user's auricle by gently pinching the auricle between said hook and said housing in cooperation with said housing, said hook (a) having a substantial shape of the letter C, (b) having means for adjusting a gap between an upper part and a lower part of the c-shape, and (c) adapted to hold a constricted part of the auricle, which attaches the auricle to the user's temporal bone of head by embracing the constricted part in a space surrounded by the C-shape; and (C) a connecting member including (a) a pivot which rotatably pivot-connects said housing and said support, and (b) a torque generator for exerting torque to narrow a gap between said housing and said support by a relative rotation thereof, in the manner that said housing and said support gently pinch the auricle therebetween in cooperation, wherein (D) said housing has a first finger-push part, (E) said support has a second finger-push part, and (F) said housing or said support has a lever configuration and rotates around said pivot by leverage widening the gap between said housing and said support against torque of said torque generator when the user pushes both of said first finger-push part and said second finger-push part with the fingers of one hand.

17. An acoustic transducer in accordance with claim 16, wherein said hook has a second gap-narrowing force generator for exerting a force to narrow a gap between said upper part and said lower part of said C-shape.

18. An acoustic transducer in accordance with claim 16, wherein said housing has roughly the same size as said auricle.

19. An acoustic transducer in accordance with claim 16, wherein said housing has a front having a convex center part.

20. An acoustic transducer in accordance with claim 16, further comprising (a) a cord for connecting said electroacoustic transducer to an outside acoustic reproducer electrically; and (b) at least one recess or protuberance on a part of said support facing away from said housing, or alternatively, on a part of said housing facing away from said support;

said recess or protuberance holding said cord when said cord is wound around two of said acoustic transducers put one upon the other or one of said acoustic transducer so as to be caught in said recess or protuberance.

21. An acoustic transducer in accordance with claim 16, wherein a part of said support for touching said constricted part is made of soft material.

22. An acoustic transducer in accordance with claim 16, wherein said first finger-push part and said pivot are provided at opposite edges of said housing.

23. An acoustic transducer in accordance with claim 16, wherein said housing includes a link having said first finger-push part and said pivot at the same edge.

24. An acoustic transducer, which comprises:

(A) a housing having an electroacoustic transducer;

(B) a support adapted to support said housing on a user's auricle be gently pinching the auricle in cooperation with said housing, said support having (a) a first hook and a second hook arranged to be substantially shaped into a letter C, thereby corresponding an upper part and a lower part of the C-shape, respectively;

(b) a pivot which rotatably pivot-connects said fist hook and said second hook, in the manner that said first hook or said second hook can rotate around said pivot and can adjust a gap between said first hook and said second hook; and (c) a torque generator for exerting torque to narrow said gap between said first hook and said second hook, in the manner that said first hook and said second hook hold a constricted part of the auricle, which attaches the auricle to the user's temporal bone of head, by embracing the constricted part in a space surrounded by the C-shape; and (C) a connecting member including (a) a second pivot which rotatably pivot-connects said housing and said support, and (b) a second torque generator for exerting torque to narrow a gap between said housing and said support by a relative rotation thereof, in the manner that said housing and said support gently pinch the auricle therebetween in cooperation, wherein (D) said housing has a first finger-push part, (E) said support has a second finger-push part, and (F) said housing or said support has a lever configuration and rotates around said second pivot by leverage widening the gap between said housing and said support against torque of said second torque generator when the user pushes both of said first finger-push part and said second finger-push part with the fingers of one hand.

25. An acoustic transducer, which comprises:

(A) a housing having an electroacoustic transducer;

(B) a support adapted to support said housing on a user's auricle be gently pinching the auricle in cooperation with said housing, said support having (a) a first hook and a second hook arranged to be substantially shaped into a letter C, thereby corresponding an upper part and a lower part of the C-shape, respectively; and (b) an elastic member connecting said first hook and said second hook for exerting an elastic force to narrow a gap between said first hook and said second hook, in the manner that said first hook and said second hook hold a constricted part of the auricle, which attaches the auricle to the user's temporal bone of head, by embracing the constricted part in a space surrounded by the C-shape; and (C) a connecting member including (a) a pivot which rotatably pivot-connects said housing and said support, and (b) a torque generator for exerting torque to narrow a gap between said housing and said support by a relative rotation thereof, in the manner that said housing and said support gently pinch the auricle there between in cooperation, wherein (D) said housing has a first finger-push part, (E) said support has a second finger-push part, and (F) said housing or said support has a lever configuration and rotates around said pivot by leverage widening the gap between said housing and said support against torque of said torque generator when the user pushes both of said first finger-push part and said second finger-push part with the fingers of one hand.

26. An acoustic transducer, which comprises:

(A) a housing having an electroacoustic transducer;

(B) a support adapted to support said housing on a user's auricle be gently pinching the auricle in cooperation with said housing, said support having (a) a first hook and a second hook arranged to be substantially shaped into a letter C, thereby corresponding an upper part and a lower part of the C-shape, respectively; and (b) a slider which slidably connects said fist hook and said second hook, and is for adjusting a gap between said first hook and said second hook by sliding said first hook or said second hook, in the manner that said first hook and said second hook hold a constricted part of the auricle, which attaches the auricle to the user's temporal bone of head, by embracing the constricted part in a space surrounded by the C-shape; and (C) a connecting member including (a) a pivot which rotatably pivot-connects said housing and said support, and (b) a torque generator for exerting torque to narrow a gap between said housing and said support by a relative rotation thereof, in the manner that said housing and said support gently pinch the auricle therebetween in cooperation, wherein (D) said housing has a first finger-push part, (E) said support has a second finger-push part, and (F) said housing or said support has a lever configuration and rotates around said pivot by leverage widening the gap between said housing and said support against torque of said torque generator when the user pushes both of said first finger-push part and said second finger-push part with the fingers of one hand.

* * * * *